United States Patent [19]

Gali Mallofre

[11] 3,982,485

[45] Sept. 28, 1976

[54] WASHING MACHINES FOR PRINTING OR PROCESSING TABLES

[76] Inventor: Salvador Gali Mallofre, Londres 29-1°,2ª, Barcelona, Spain

[22] Filed: June 24, 1975

[21] Appl. No.: 589,834

[30] Foreign Application Priority Data

Nov. 20, 1974 Spain ..... 432.130

[52] U.S. Cl. ..... 101/425; 15/77; 15/87; 15/256.5

[51] Int. Cl.[2] ..... B41F 35/00; B41L 41/00

[58] Field of Search ..... 101/423, 424, 425; 15/77, 102, 87, 246, 256.5

[56] References Cited

UNITED STATES PATENTS

| | | | |
|---|---|---|---|
| 993,603 | 5/1911 | Jones | 15/87 |
| 1,883,223 | 10/1932 | Wood | 101/423 |
| 2,291,553 | 7/1942 | Mathy et al. | 15/77 |
| 3.252,416 | 5/1966 | Allen | 101/425 |

*Primary Examiner*—Edgar S. Burr
*Assistant Examiner*—Paul J. Hirsch
*Attorney, Agent, or Firm*—Wenderoth, Lind & Ponack

[57] ABSTRACT

A washing machine for a printing or processing table including an arrangement of two complementary carriages, each one of which rests on a lateral rail provided along opposite sides of the table for the tracking of the carriages. The carriages are solidly fixed to each other by means of a bridge element comprised of two telescopically arranged tubular bodies which are provided with adjustment and fixing means capable of securing the coupling of the tubular bodies to any relative dimension between two points, one of which is of maximum approximation while the other is of maximum separation. Each one of the carriages is provided with a cantilever arm directed inwardly of the table, which arms are longer than half the width of the table and support a plurality of circular brushes, each of the brushes being provided with a gear. The brushes are arranged in a zig-zag configuration and are suspended from pneumatic pistons the path of travel of which is greater than the distance which separates the brushes from the table and the pressure of which is limited by the action of a regulating valve. The telescopic tubes of the bridge are connected by a spindle and fixed nut device.

1 Claim, 4 Drawing Figures

WASHING MACHINES FOR PRINTING OR PROCESSING TABLES

BACKGROUND OF THE INVENTION

The present invention relates to improvements in washing machines for printing or processing tables, which tables constitute a support surface for a textile piece undergoing the action of a screen printing device.

The length of these tables is such that, as the processing machines have become automated and thus advance at faster speeds, and in view of the permeability of the cloth, the support surface or table itself is inevitably stained. Thus, cleaning of the table surface is required before a new piece of clean cloth may be placed thereon.

The large length of the tables, up to 250 meters or more in some installations, makes manual cleaning prohibitive, and consequently automatic washing machines which carry out this task rapidly and efficiently have been developed.

The conventional washing machine includes a carriage, the purpose of which is to transport tanks containing cleaning liquid as well as cleaning brushes. The carriage employs, as a roller track, rails with which the table is provided to guide the processing carriage. Furthermore, since automatic processing machines are driven and regulated by pneumatic power, an identical controlling and driving system has been used for the washing machines.

The carriage thus driven by a pneumatic motor includes a series of brushes having frontal hairs or bristles which sweep the surface of the table with a rapid rotational movement, while the cleaning liquid is poured thereon. These brushes, which are disposed in a zig-zag arrangement transversely across the table, have gears which mesh with toothed sectors by means of adjacent brush gears and by which the rotational direction of the brushes may be reversed.

The cleaning liquid is distributed onto the table either by means of nozzles or through a perforated blind conduit.

The washing machine effects two useful runs, one in a first direction for cleaning by brushing, and the other in an opposite direction to rinse, drain off by means of scrapers, and absorb the water by means of suction nozzles, which are provided in the carriage which supports the assembly and which are connected to a collecting tank for collecting the dirty water.

The scrapers which slide along the surface of the table are in the form of a support incorporating a channel or tank which collects the dirty water and directs it to the corresponding suction nozzles.

This type of washing machine has an important shortcoming in that it is limited by the space between the rails which corresponds to the width of the processing table. However, it is a known fact that the widths of the various tables vary and, unless a factory prints cloth of only a single width, it is necessary to have as many washing machines as widths of the tables employed.

On the other hand, the surfaces of the tables are very smooth, and washing thereof is not as perfect or complete as desired. Thus, it is necessary to manually clean those zones which are not sufficiently cleaned by the automatic machine.

SUMMARY OF THE INVENTION

To avoid the above disadvantages, the present invention provides the above type of washing machines with the following improvements:

A. Adjustment of the space between rails.

B. Independence in the lowering of the individual brushes.

With the former improvement, the washing machine can be adapted to the different widths of the existing tables, i.e. from a maximum for the widest table, to a minimum corresponding to the narrowest table.

Due to the latter improvement, each of the brushes is maintained in contact with the surface of the table, and always under a uniform pressure.

BRIEF DESCRIPTION OF THE DRAWINGS

To complement the following detailed description and for a better understanding of the characteristics of the invention, reference is made to the attached drawings wherein.

DETAILED DESCRIPTION OF THE INVENTION

Figure 1:
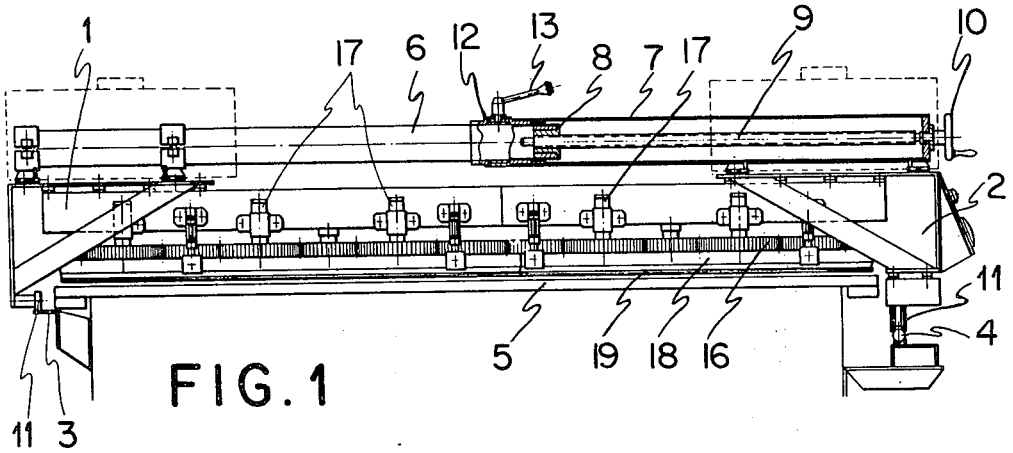
FIG. 1 is a longitudinal elevational view of the washing machine according to the present invention.

As can be seen in the drawings, the washing machine for processing tables of the present invention includes the arrangement of two complementary carriages 1 and 2, respectively resting on the lateral rails 3 and 4 provided at opposite sides of the table 5 for the tracking of the processing machine.

These carriages 1 and 2 are solidly fixed to each other by a bridge element formed by two tubular bodies 6 and 7, telescopically arranged to each other and provided with an adjusting device capable of securing the coupling of such bodies 6 and 7 to any relative position between two points, one of maximum approximation and the other of maximum separation.

One example of a suitable adjusting device is illustrated and includes a nut 8 attached to the outer end of the tubular body 6. A spindle 9 extends through the tubular body 7 and meshes with nut 8. Spindle 9 has a manually operated handwheel 10 with which it is possible to adjust the rail width between wheels 11 of carriages 1 and 2 to adapt the assembly to a given table 5.

The position of tubular bodies 6 and 7 may be locked by a suitable fixing device, one example of which is illustrated and includes a plate 12 mounted on the end of the tubular body 7, through which extends a rotatable locking handle 13. Thereby, the relative position of the tubular bodies 6 and 7 and the respective carriages 1 and 2 may be locked when they have been adjusted to the width of the processing table in question. When it is desired to further adjust the carriages, handle 13 is loosened in plate 12, and handwheel 10 and spindle 9 are rotated to further cause the tubular bodies 6 and 7 to move telescopically.

Each of the carriages 1 and 2 is provided with a cantilever arm 14 which is directed inwardly of the table 5 by a distance more than half of the width thereof. Arms 14 form supports for mounting a plurality of circular brushes 15 each having attached thereto a gear 16, the gears of adjacent brushes being in meshing engagement. Thus, the brushes may all be rotated by applying a rotating drive to only one of the brushes, since the remaining brushes are driven due to the meshing of gears 16.

Figure 3:
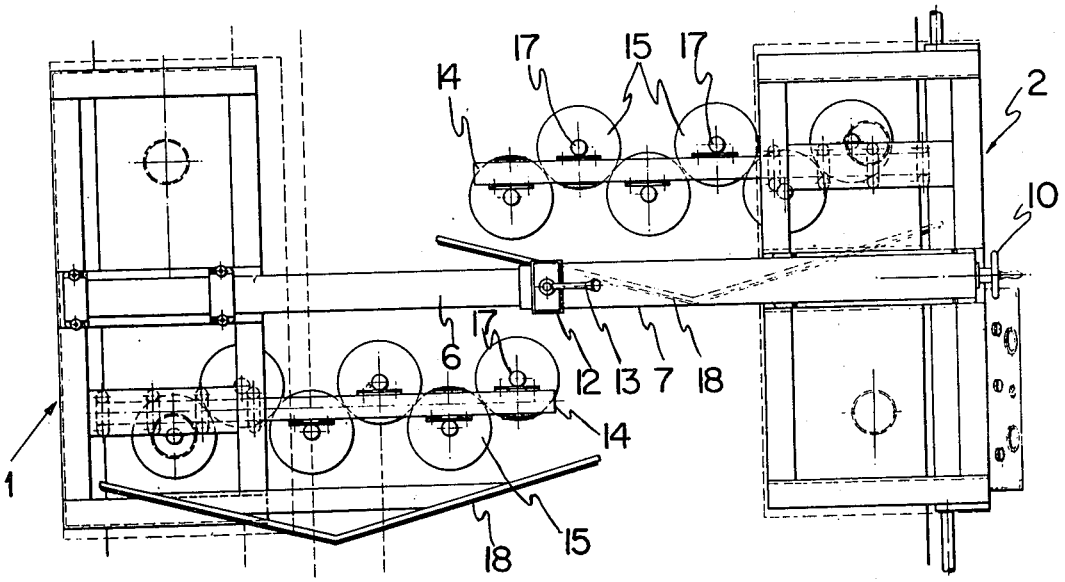
FIG. 3 is an upper plan view of the washing machine, wherein the position of the arms which support the brushes and the tangential relation thereof being shown, and with one of the brushes being driven by a drive means and providing a gear drive for the remaining brushes on the arm by a gear train.
Figure 2:
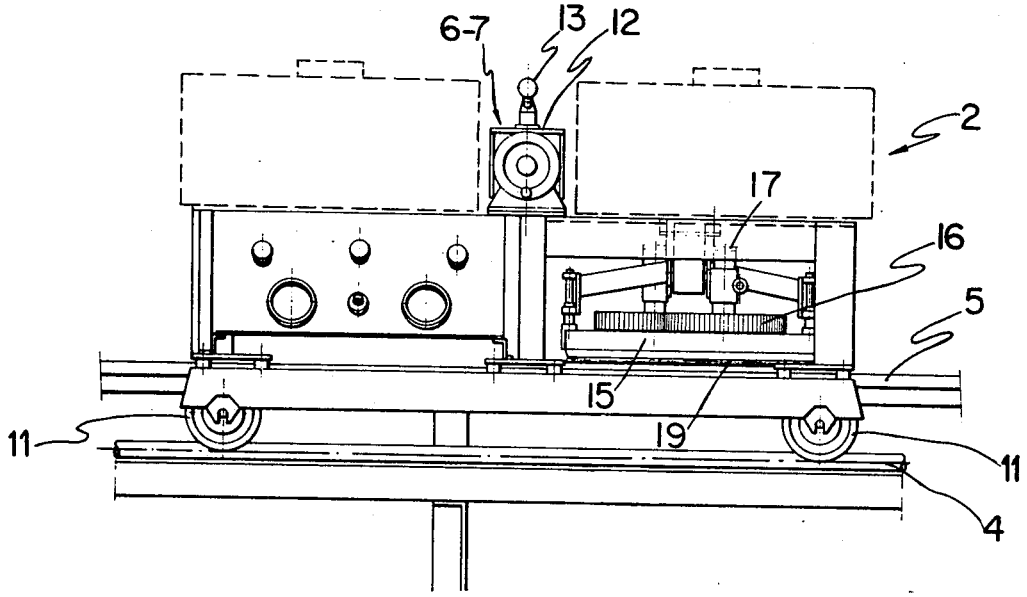
FIG. 2 is a cross-sectional elevational view of the washing machine, wherein one of the carriages, the driver, the control console, the frame, the wheels, the end pieces of the bridge and one of the arms supporting the brushes can be seen, the dotted lines corresponding to tanks which contain the cleaning liquid and which collect the dirty water.
Figure 4:
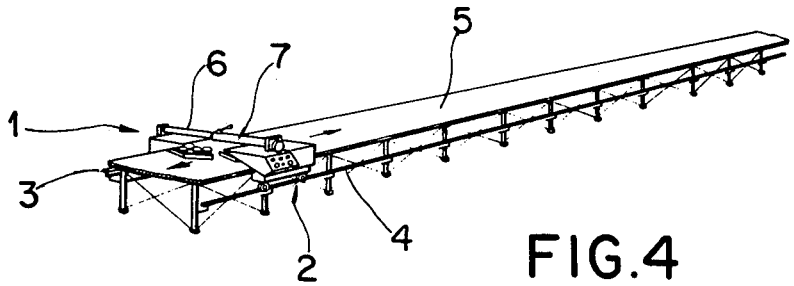
FIG. 4 is a perspective view of a conventional processing table on which a washing machine according to the present invention circulates.

As can be seen from FIG. 3, the brushes 15 on each respective arm 14 are arranged in a zig-zag alignment and are supported by the arrangement of supports 17 which are pneumatic pistons, the path of travel of which is greater than the distance which separates the brushes 15 from the table 5, and the pressure of which is limited by the action of a regulating valve. Thus, when the system is activated, the brushes 15 are caused to perfectly and completely contact the surface of the table 5, and it is impossible for zones or portions of the table surface to be untreated or not cleaned.

Scrapers 18 slide along the surface of the table 5, when the washing machine advances in one direction therealong, and divert impurities in an opposite working direction. Scrapers 18 include a support having a channel 19 at the side or lower edge thereof which, when in contact with the smooth surface of the table 5, collects dirty water and directs it to appropriately positioned devices such as suction nozzles.

I claim:

1. A washing machine for printing or processing tables, the washing machine comprising:

an arrangement of two complementary carriages, each of said carriages adapted to be mounted for movement on laterally extending rails mounted on opposite sides of a printing table to be cleaned;

means for adjustably coupling said carriages together transversely of said printing table to permit adjustment corresponding to the width of said printing table, said means for coupling comprising a tubular body mounted on each of said carriages, said tubular bodies being joined in telescopic relationship for coupling one of said carriages to the other of said carriages;

each of said carriages having a cantilever arm extending across more than half the width of said printing table, each of said arms supporting a plurality of circular brushes, a gear on each of said brushes for receiving a driving force from an adjacent one of said brushes or from a drive means, said brushes being mounted along each of said arms in a zig-zag arrangement;

each of said brushes being carried by pneumatic pistons for movement of the brushes to and from the surface of the table, the path of travel of said piston being longer than the distance which separates the brushes from the table, a valve for regulating pressure applied by said brushes; and said tubular bodies being provided with a spindle and a fixed nut capable of adjustment in either direction relative to the width of the table, and a handwheel connected by means of the spindle to the fixed nut for adjustment of the relative position between said telescoping tubular bodies and, therefore, the width between the carriages.

* * * * *